United States Patent [19]

Geremia

[11] 4,434,330

[45] Feb. 28, 1984

[54] HIGH TEMPERATURE SWITCH

[75] Inventor: Leo F. Geremia, Wallingford, Conn.

[73] Assignee: Tri-tech, Inc., Waterbury, Conn.

[21] Appl. No.: 252,475

[22] Filed: Apr. 9, 1981

[51] Int. Cl.[3] ..... H01H 21/04

[52] U.S. Cl. ..... 200/67 DA; 200/153 T; 200/335

[58] Field of Search ..... 200/67 DA, 67 B, 67 DB, 200/67 PK, 67 G, 153 H, 335, 153 T

[56] References Cited

U.S. PATENT DOCUMENTS

| | | | |
|---|---|---|---|
| 2,355,951 | 8/1944 | Coffeen et al. | 200/67 DA |
| 2,842,644 | 7/1958 | Korsgren, Sr. | 200/168 |
| 2,878,348 | 3/1959 | Haydon et al. | 200/168 |
| 2,977,447 | 3/1961 | Korsgren, Sr. et al. | 200/153 |
| 3,062,932 | 11/1962 | Korsgren, Sr. et al. | 200/67 |
| 3,089,009 | 5/1963 | Korsgren, Sr. | 200/83 |
| 3,236,964 | 2/1966 | Sommer | 200/87 |
| 3,319,021 | 5/1967 | Good | 200/67 D |
| 3,339,048 | 8/1967 | Haderer | 200/67 DB |
| 3,427,420 | 2/1969 | Geremia et al. | 200/172 |
| 3,484,572 | 12/1969 | Froyd | 200/332 |
| 3,513,274 | 5/1970 | Jullien-Davin | 200/67 D |
| 3,543,589 | 12/1970 | Loughran | 74/54 |
| 4,295,017 | 10/1981 | Kashima et al. | 200/153 T |

FOREIGN PATENT DOCUMENTS

| | | |
|---|---|---|
| 1136160 | 12/1968 | United Kingdom . |
| 1370016 | 10/1974 | United Kingdom . |

*Primary Examiner*—Willis Little

*Attorney, Agent, or Firm*—Lee C. Robinson, Jr.

[57] ABSTRACT

A environmentally sealed snap action switch mechanism suitable for use in high temperature (900° F.+) environments comprises a casing having a flex area formed on one surface so as to be susceptible to snap-action movement. A switch is situated inside the casing. An inner actuator leaf affixed at one end to the flex area links the latter with the switch. An outer actuator leaf is affixed to the flex area on the outside of the casing. The outer and inner actuator leaves move in concert to open and close the switch and cause the flex area to snap between normal and actuated conditions. To ensure proper performance at high temperatures, a helper leaf spring extends between the outer actuator arm and the exterior surface of the casing to bias the outer actuator arm away from the casing. Preferably, the switch includes a flexible steel blade, and, in one version, includes a two-layer blade to achieve extended switch life.

22 Claims, 7 Drawing Figures

FIG. 1
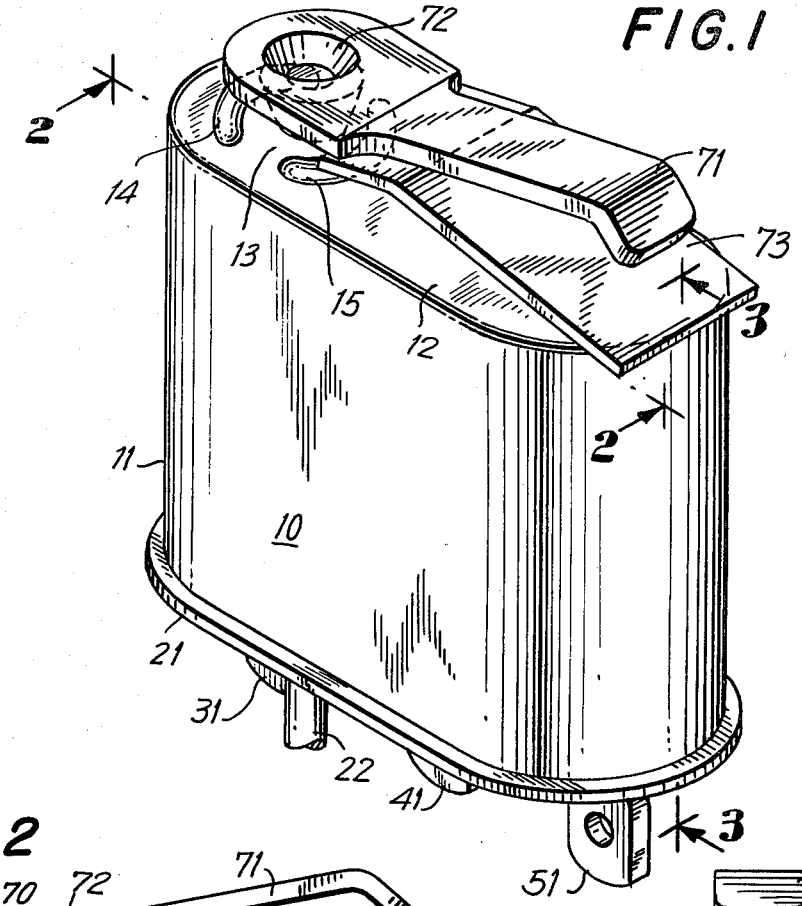
FIG. 2
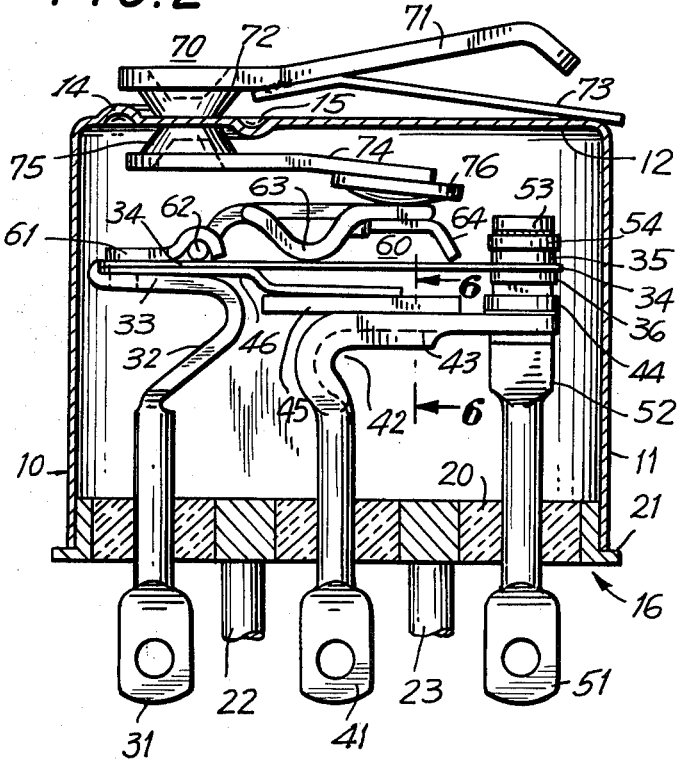
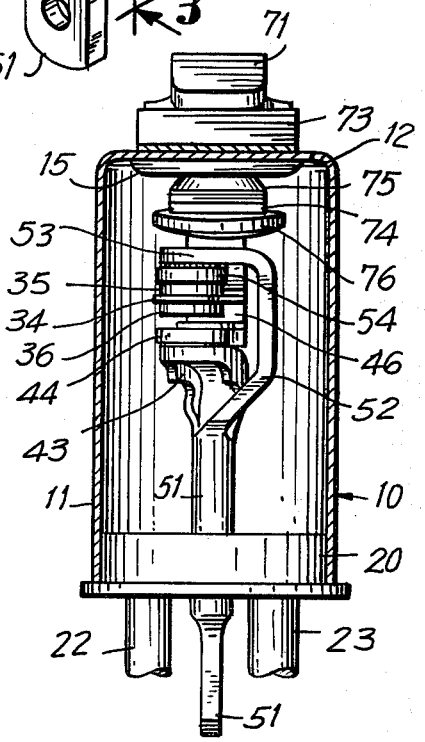
FIG. 3

HIGH TEMPERATURE SWITCH

BACKGROUND OF THE INVENTION

The present invention relates to environmentally sealed switches, and particularly to sealed switches of the snap-action type. This invention is especially directed to such switches adapted for use in a high-temperature environment, like that found in aerospace applications.

Modern aerospace vehicles, particularly jet and turboprop aircraft and rocket-powered spacecraft, require electrical switches to initiate certain automatic functions or to signal to the pilot and crew of the craft in response to movements of parts and appurtenances of the craft. For example, such a switch is used in a multi-jet-engine plane and comes into play during a braking operation. A baffle provided for each engine is moved into position to deflect the jet exhaust forwardly to help brake the plane's movement, and the switch opens and closes in response to movement of the baffle to apprise the crew of the condition of this baffle for each engine.

It is desirable that the switch be small, positive in action, and rugged, and a snap-action switch can be favorably employed to this end. Furthermore, in the above described environment, where temperatures can reach or exceed 900° F., the switch construction must be reliable despite high temperatures. In addition, the switch is desirably sealed to protect its delicate internal mechanism from condensation, frost, or corrosives in the jet exhaust.

Previous sealed-snap-action switches, such as that described in U.S. Pat. No. 3,089,009, to T. Y. Korsgren, Sr., have included an actuator supported by a flexible seal in an opening of the switch's casing. In such a switch extreme swings in pressure and/or temperature can affect the sensitivity of the switch, and sustained exposure to high temperatures can damage the flexible seal.

OBJECTS AND SUMMARY OF THE INVENTION

A desired object of this invention is to provide a rugged and reliable environmentally sealed switch that is well suited to use in a high temperature environment.

More specifically, it is an object of this invention to provide such a switch, which can be exposed to temperatures of or exceeding 900° F. and which will operate reliably in such an environment without fail for at last 25,000 actuations.

In accordance with a number of preferred embodiments of this invention, a high temperature snap-action switch mechanism includes a casing with a switch mechanism environmentally sealed inside, and having a flex portion formed on a surface of the casing. The flex portion provides a measure of snap action when flexed. An outer actuator leaf has one end affixed on the outside of the casing to the flex portion, and an inner actuator leaf has an end similarly affixed on the inside to the flex portion. This construction permits the inner actuator leaf to pivot with the outer leaf. The flex portion is favorably formed to provide snap action when flexed by movement of the actuator leaves. The actuator leaves can be favorably spot welded to the flex portion.

A switch device, for example, including a flexible blade, is actuated by the movement of the inner actuator leaf, to selectively open and close in response to movement of the actuator leaves.

At high temperatures the resilience of the blade, or other type switch, might not be sufficient to restore the actuator leaves from their actuated condition to their normal condition, and a helper spring is included to help urge these actuator leaves to their normal condition.

According to one possible desirable embodiment, this helper spring is a leaf spring affixed to the outer actuator leaf and biased against the top of the casing. However, in other embodiments, the helper spring can be a helical spring, or can be coupled between the inner actuator leaf and the inside of the casing.

In several desirable embodiments, the flex area on the casing is defined by a convex arcuate boss and an associated concave arcuate indentation, arranged with their open sides towards one another so that the flex area is generally disc shaped, and the flex area snaps between flexed and unflexed positions in response to motion of the actuator leaves.

Many other embodiments of this invention are possible, and the following description of one illustrative embodiment is offered, to be considered with the accompanying drawings, from which other additional aspects and advantages of this invention will become apparent.

BRIEF DESCRIPTION OF THE DRAWINGS

FIG. 1 is an isometric view of one embodiment of a high temperature switch according to this invention.

FIGS. 2 and 3 are respectively front and side elevational views taken along the planes 2—2 and 3—3 of FIG. 1.

DETAILED DESCRIPTION OF A PREFERRED EMBODIMENT

Figure 4:
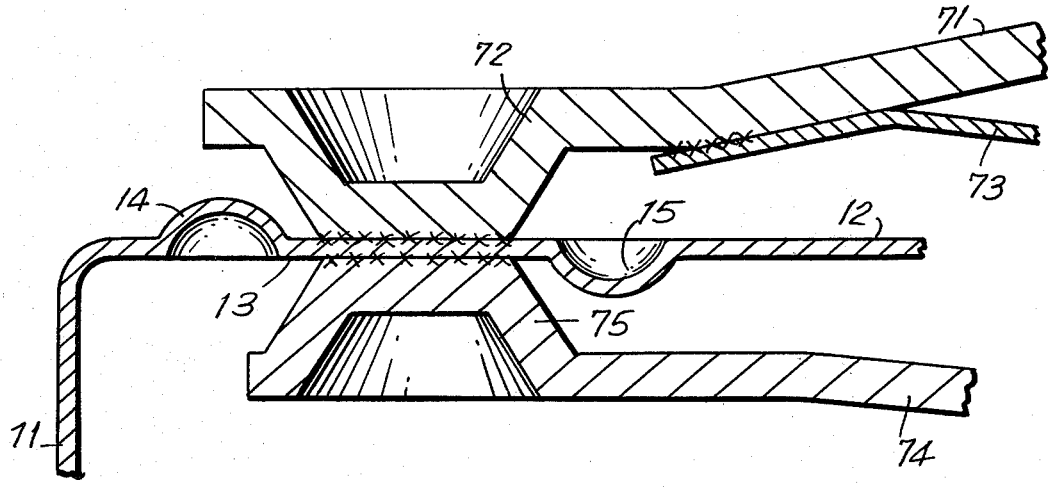
FIGS. 4 and 5 are views of the actuating mechanism of the switch of FIGS. 1–3, and are useful in explaining the operation thereof.

A switch mechanism constructed according to this invention, and which is well suited for use in a high temperature environment, will now be described with reference to the drawings and initially to FIGS. 1–3.

Initially, a cover or case 10 of the switch includes a vertical wall 11, here formed generally as an oval cylindrical surface, and a top surface 12. A generally disc-shaped flat flex area 13 is formed between a crescent-shaped boss 14 and a crescent-shaped indentation 15. The boss 14 and the indentation 15 are respectively convex and concave, as viewed from the outside of the case, such as in FIG. 1, and allow the flex area 13 to enjoy snap-action movement. The cover 10 also has a bottom end 16 opposite the top surface 12 at which is disposed a high-temperature metal base plate 21. High temperature glass insulators **20*a*, 20*b*, 20*c* are embedded in the base plate 21, to form an environmental seal. An evacuation tube 23 is provided, embedded into the base plate 20**, for removing moisture by evacuating the switch mechanism and back filling with dry nitrogen or other inert gas.

A triad of electrodes 31, 41, and 51 are provided extending from the exterior of the base plate into the sealed interior of the switch mechanism. The electrodes are each held in place in the base by a respective insulator 20*a*, 20*b*, 20*c*. In this version, these insulators are glass. The glass-metal seal will not be perfect at high temperatures, but will keep moisture and dust out from the inside of the case. If a better seal is required, for example if the temperature requirements exceed 1000° F., alumina (ceramic) insulators can be used instead of glass.

The electrode 31 is a "common" electrode, and has a flattened figure-seven-shaped portion 32 whose cross member forms a horizontal support table 33. A flexible resilient conductive blade 34 is fastened at one end at the support table 33 and has an upper contact 35 and a lower contact 36 disposed at the other, or free end thereof.

Figure 6:
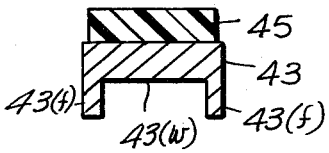
FIG. 6 is a cross-sectional view of a portion of the switch of FIGS. 1–3.

The electrode 41 is a "normally-open" electrode and has a J-shaped portion 42 having a horizontal support platform 43 disposed a short distance below the position of the blade 34. As best shown in FIG. 6, the support platform is formed as a channel member with vertical flanges 43(*f*) on either side of a horizontally-disposed web 43(*w*). A contact 44 is disposed at the end of the support platform 43 and is adapted to mate electrically with the lower contact 36.

Also disposed on the support platform 43, and as best shown in FIG. 6, is a flat insulator 45. A dog-leg-shaped blade support 46 extends between the support table 33 and the flat insulator 45 to provide additional support for the blade 34.

The electrode 51 is a "normally-closed" electrode. A flattened and bowed support arm 52 (FIG. 3) extends around the support platform 43 and the blade 34, and a horizontal portion 53 atop the support arm 52 supports an overhead contact 54. The latter is adapted to mate electrically with the upper contact 35.

An actuator arrangement 60, generally in the form of a swingable arm, is hingedly disposed atop the blade 34 to pivot from the fixed end of the blade 34 and to depress the blade 34. The arrangement 60 selectively opens the contacts 35 and 54 while closing the contacts 36 and 44.

A hinge eye 61 is affixed to the support 33 and to the fixed end of the blade 34. A horizontal pin 62 extends through the eye 61 to permit swinging movement in the vertical plane. The actuator mechanism 60 includes an intermediate arch 63 and a finger 64 which respectively bear at an intermediate portion of the blade 34 and at the end thereof near the contacts 35 and 36.

The actuator arrangement 60 is favorably adapted to provide for substantial overtravel in its movement without causing damage to the blade 34 or other portions of the switch mechanism. Structure of the actuator arrangement 60 which would permit such overtravel could be based on the switching device disclosed in U.S. Pat. No. 3,062,932 to T. Y. Korsgren et al., or could be based on any of several other possible schemes.

An actuator leaf arrangement 70 for actuating the blade 34 with snap-action movement includes an outer arm or leaf 71 having a portion 72 thereof (here formed as a conic frustrum) spot-welded or otherwise affixed to the flex area 13. A helper leaf spring 73 is welded to the underside of the actuator leaf 71 and is slidably biased against the corner of the top surface 12 with the wall 11. This helper leaf spring 73 is operative to bias the outer actuator leaf to the normal position as shown in FIG. 4.

The arrangement 70 also includes an inner arm or leaf 74 which also has a portion 75 (here also formed as a conic frustrum) spot welded or otherwise affixed on the inside of the case 10 at the flex area 13. A button 76 is disposed on the free end of the leaf 74, i.e., at the end remote from the flex area 13. This button contacts the actuator arm 60 to push it downward, so that the blade 34 is actuated in response to the concerted downward movement of the outer and inner actuator leaves 71 and 74. In this embodiment, the button 76 is an insulator, thereby electrically isolating the blade 34 from the case 10.

The outer actuator leaf 71 acts as a control lever to control the flexing (and snapping) of the flex area 13, and the inner actuator leaf 74, and the actuator arrangement 60 acts as a linkage to link movement of the blade 34 with movement of the outer actuator leaf 71.

Figure 5:
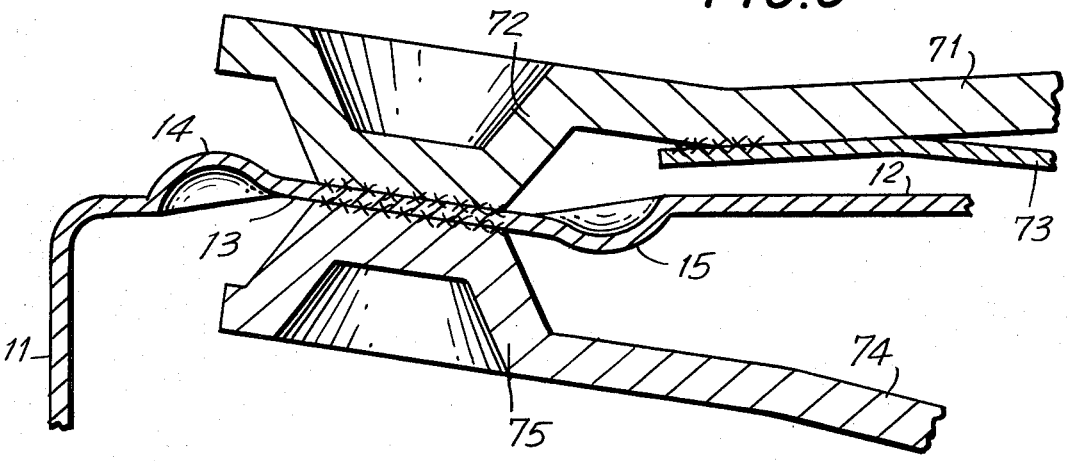

The operation of the high temperature switch of this invention can be explained by reference to FIGS. 4 and 5.

Normally, the actuator leaves 71 and 74 of the above embodiment assume the position illustrated in FIG. 4. In such position, the normally-closed contacts 35 and 54 electrically mate and the common electrode 31 is thus coupled to the normally-closed electrode 51.

However, if a force is brought to bear down on the free end of the actuating leaf 71, the same is caused to pivot about the flex portion 13 of the casing 10. After a limited amount of displacement, the flex portion 13 moves with snap action to bring the leaves 71 and 74 to an actuated position, as illustrated in FIG. 5. In this position, the rear portion of flex area 13, i.e. near the boss 14, rises, while the forward portion, i.e. near the indentation 15, drops.

In the actuated position, the button 76 on the end of the inner leaf 74 bears down on the actuating arm 60, which, in turn, pushes the blade 34 down to open the normally-closed contacts 35 and 54, and to close the normally-open contacts 36 and 44. Thus, in the actuated position, the common electrode 31 is electrically connected with the normally-open electrode 41.

When pressure is released from the free end of the outer actuating leaf 71, the resilience provided from the blade 34 and the flex portion 13 is normally sufficient to return the leaves 71 and 74 to the position shown in FIG. 4. However, because the resilience of the blade 34 and the flex area 13 diminishes somewhat at extremely high temperatures, the helper spring 73 is provided to furnish sufficient additional force that is required to return the leaves 71 and 74 to the normal position.

Figure 7:
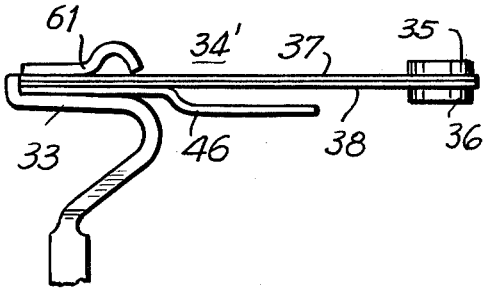
FIG. 7 is a portion of the view of FIG. 3, illustrating one alternative arrangement of the switch of this invention.

The blade 34 illustrated in FIGS. 2 and 3 is formed of a single flexible steel leaf of nominal thickness, for example, of 5 mils. However, as depicted in FIG. 7, it is also possible to construct the blade 34 of an upper layer 37 and a lower layer 38, each of 3 mil thickness, for example, thereby giving a total blade thickness of 6 mils. This arrangement has an increased amount of flexing strength, which increases the life of the blade.

The switch cover 10 and the actuator arrangement 70 are preferably heat treated during construction to assure correct mechanical properties. First, the cover 10, the leaves 71 and 74, and the spring 73 are assembled. Then the assembly is subjected to an austenite-conditioning operation by heating to 140° F.±25° F. and maintaining that temperature for approximately 90 minutes. Then, the assembly is cooled within one hour to a temperature of 50° F. to 60° F. That temperature is held for one-half hour. Then follows a precipitation hardening in which the assembly is heated to 1150°–1175° F.

for one hour, after which the assembly is air-cooled to room temperature.

The blade 34, the actuator leaves 71 and 74, and the helper spring 73 are favorably formed of Elgiloy 1125 and the cover is preferably formed of 17-7PH stainless steel of 10 mils thickness.

The switch constructed as above according to this invention will reliably give at least 25,000 operations without fail, and can be expected to have a mean of at least 30,000 to 45,000 operations before failure.

Also, once the switch has been assembled, and the switch has been properly evacuated and back filled through the evacuation tube 23, the latter is crimped or cut, and then the resulting hole is sealed off.

The term "environmentally sealed" as used herein is meant to be descriptive of the seal attained when the glass insulators 20*a*–20*c* are disposed in the base plate 21. Unlike a hermetic seal, this environmental seal may permit a small amount of gas transfer at extremely high temperatures. However, this seal will prevent moisture, smoke, or caustic fumes from entering the switch mechanism.

In the above description, terms of orientation, such as "horizontal" and "down," are intended to indicate direction only with respect to the drawings. Switches according to this invention can, of course, be oriented in any arbitrary direction.

While one embodiment of this invention has been illustrated and described hereinabove, many possible embodiments and variations thereof will be apparent to persons of ordinary skill without departure from the scope and spirit of this invention, as defined in the appended claims.

What is claimed is:

1. A switch mechanism for use in a high temperature environment comprising enclosure means defining an interior and an exterior and having a surface on which is formed a flex portion adapted for flex movement; electrodes extending into the interior of the enclosure means; an outer actuator having one end affixed at said flex portion on the exterior of the enclosure means and a remote free end; an inner actuator having one end affixed at said flex portion on the interior of the enclosure means and a remote free end; switch means in contact with the free end of said inner actuator and actuable between normal and actuated conditions for coupling said electrodes to selectively open and close in response to movement of the outer actuator; and helper spring means coupled to said outer actuator and biasing against said enclosure means when said outer actuator is depressed into an actuated position thereof for biasing said actuators to their position corresponding to the normal condition of said switch means.

2. A switch mechanism for use in a high temperature environment comprising enclosure means defining an interior and an exterior and having a surface on which is formed a flex portion adapted for flex movement; electrodes extending into the interior of the enclosure means; an outer actuator having one end thereof spot welded to said flex portion on the exterior of the enclosure means and a remote free end; an inner actuator having one end spot welded on said flex portion on the interior of said enclosure means and a remote free end; switch means in contact with the free end of said inner actuator and actuable between normal and actuated conditions for coupling said electrodes to selectively open and close in response to movement of the outer actuator; and helper spring means affixed to one of said outer and inner actuators and resiliently urging the same away from said enclosure means, said urging being continuously maintained when said actuators are moved into or beyond actuated positions thereof; said helper spring means serving to bias said actuators to their position corresponding to the normal condition of said switch means.

3. A switch mechanism for use in a high temperature environment comprising enclosure means defining an interior and an exterior and having a surface on which is formed a flex portion adapted for flex movement wherein said enclosure means includes first and second arcuate indentations defining the flex portion therebetween; electrodes extending into the interior of the enclosure means; an outer actuator having one end affixed at said flex portion on the exterior of the enclosure means and a remote free end; an inner actuator having one end affixed at said flex portion on the interior of the enclosure means and a remote free end; switch means in contact with the free end of said inner actuator and actuable between normal and actuated conditions for coupling said electrodes to selectively open and close in response to movement of the outer actuator; and helper spring means disposed between said enclosure means and said outer actuator for biasing said actuators to their position corresponding to the normal condition of said switch means.

4. A switch mechanism according to claim 3, wherein said first and second arcuate indentations are concave and convex, respectively, with respect to the exterior of the enclosure means.

5. A switch mechanism for use in a high temperature environment comprising a base plate, cover means mounted on said base plate to define an interior and an exterior and having a surface on which is formed a flat portion adapted for flex movement, a plurality of electrodes extending through the base plate into the interior of the switch mechanism; an outer actuator leaf having one end affixed at said flat portion on the exterior of the cover means and a free end remote therefrom; a helper spring affixed to said outer actuator leaf and biased against the exterior of the cover means to urge the free end of the outer actuator leaf away from the cover means; an inner actuator having one end affixed at said flat portion on the interior of said cover means and a free end; and switch means in contact with the free end of said inner actuator for coupling said electrodes to selectively open and close in response to movement of the outer actuator leaf.

6. A switch mechanism according to claim 5, further comprising sealing means disposed between said cover means and said base plate to form a seal therebetween.

7. A snap action switch mechanism for use in a high temperature environment comprising a base plate, a case mounted on said base plate to define an interior and an exterior sealed from each other, and having a surface on which is formed a flat portion adapted for flex movement, a first conductive post extending through the base plate into the interior of the switch case and including a flat support table formed thereon; a flexible resilient conductive blade affixed at one end onto the support table of said first conductive post and having at least one contact disposed at the other end thereof; a second conductive post extending into the interior of said case having a flat support portion extending generally parallel to and beneath said blade; a contact on said conductive post adapted to close with the at least one contact disposed on the blade; an outer actuator leaf having one end affixed at said flat portion on the exterior of said case and a free end remote therefrom; a helper spring affixed to said outer actuator leaf and biased against the exterior of the case to urge the free end of the outer actuator leaf away from this case; an inner actuator leaf having one end affixed at said flat portion on the interior of said case and a free end remote therefrom; and means in contact with the free end of said inner actuator leaf and with said blade for moving said blade so that the at least one contact mounted thereon selectively closes with the contact on said second conductive post in response to movement of the outer actuator leaf.

8. A snap action switch mechanism for use in a high temperature environment comprising a base plate, a case mounted on said base plate to define an interior and an exterior sealed from each other, and having a surface on which is formed a flat portion adapted for flex movement, a first conductive post extending through the base plate into the interior of the switch case and including a flat support table formed thereon; a flexible resilient blade affixed at one end onto the support table of said first conductive post and having at least one contact disposed at the other end thereof; a second conductive post extending into the interior of said switch case having a flat support portion extending generally parallel to and beneath said blade; a flat insulator atop a portion of said flat support portion; a blade support member mounted at one end thereof upon said flat insulator and at another end thereof upon said support table; a lower contact on said second conductive post adapted to close with at least one contact disposed on the blade; an outer actuator leaf having one end affixed at said flat portion on the exterior of the case and a free end remote therefrom; a helper string affixed to said outer actuator leaf and biased against the exterior of the case to urge the free end of the outer actuator leaf away from the case; an inner actuator leaf having one end affixed at said flat portion on the interior of said case and a free end remote therefrom; and means in contact with the free end of said inner actuator leaf and with said blade for moving said blade so that the at least one contact mounted thereon will selectively close with said lower contact in response to movement of the outer actuator leaf.

9. A snap action switch for use in a high temperature environment comprising a base plate, a case mounted on said base plate to define an interior and an exterior and having a surface on which is formed a flat portion adapted for flex movement, a first conductive post extending through the base plate into the interior of the switch case and including a flat support table formed thereon; a flexible resilient blade affixed at one end onto the support table of said first conductive post and having at least one contact disposed at the other end thereof; a second conductive post extending into the interior of said case having a support arm formed thereon extending around and above said blade; an upper contact on said support arm adapted to close with the at least one contact disposed on the blade; an outer actuator leaf having one end affixed at said flat portion on the exterior of the case and a free end remote therefrom; a helper spring affixed to said outer actuator leaf and biased against the exterior of the case to urge the free end of the outer actuator leaf away from the case; an inner actuator leaf having one end affixed at said flat portion on the interior of said case and a free end remote therefrom; and means in contact with the free end of said inner actuator leaf and with said blade for moving said blade so that the at least one contact mounted thereon will selectively close with said upper contact in response to movement of the outer actuator leaf.

10. A snap action switch for use in a high temperature environment comprising a base plate, a case mounted on said base plate to define an interior and an exterior and having a surface on which is formed a flat portion adapted for flex movement, a first conductive post extending through the base plate into the interior of the switch case and including a flat support table formed thereon; a flexible resilient conductive blade affixed at one end onto the support table of said first conductive post and having contacts disposed on opposite sides at the other end thereof; a second conductive post extending into the interior of said case having a flat support portion extending generally parallel to and beneath said blade; a blade portion member mounted on said flat support portion to support a portion of said blade; a lower contact on said second conductive post adapted to contact one of the contacts disposed on the blade; a third support post extending through said base plate into the interior of said switch case and having a flattened support arm formed thereon extending around and above said blade; an upper contact on said flattened support arm adapted to contact the other of the contacts disposed on the blade; an outer actuator leaf having one end affixed at said flat portion on the exterior of the case and a free end remote therefrom; an inner actuator leaf having one end affixed at said flat portion on the interior of said case and a free end remote therefrom; means in contact with the free end of said inner actuator leaf and with said blade for moving said blade so that the contacts mounted thereon selectively close with one of said upper contact and said lower contact in response to movement of the outer actuator leaf; and resilient means coupled to said case and to at least one of said actuator leaves for acting to urge the remote end of the outer actuator leaf away from the case.

11. A switch mechanism for use in a high temperature environment comprising enclosure means defining an interior and an exterior and having a surface on which is formed a flex portion adapted for flex movement, a first conductive post extending into the interior of the enclosure means and including blade-supporting means formed thereon; a flexible resilient conductive blade affixed at one end onto the blade supporting means of said first conductive post and having at least one contact disposed at the other end thereof; a second conductive post extending into the interior of said enclosure means and having a contact disposed thereon adapted to close with the at least one contact disposed on the blade; an actuator mechanism including an outer arm disposed on the exterior of said enclosure means having one end positioned at said flex portion, an inner arm disposed on the interior of said enclosure means and coupled to said one end the outer arm to move with said outer arm generally toward and away from said surface of the enclosure means; a leaf spring mounted between said outer arm and said surface of the enclosure means to urge the outer arm away therefrom; and a blade actuating member disposed between said inner arm and said blade, and pivoted on said blade-supporting means to urge said blade to move in response to movement of said outer arm to selectively close said contacts.

12. A switch mechanism according to claim 11, wherein one of said inner arm and said blade-actuating member includes means electrically insulating said blade from said inner arm.

13. A switch mechanism for use in a high temperature evironment comprising enclosure means defining an interior and an exterior and having a surface on which is formed a flex portion adapted for flex movement, a first conductive post extending into the interior of the enclosure means and including a blade support formed thereon; a flexible resilient conductive blade arrangement formed of two thicknesses of resilient conductive material affixed atop one another, with the blade arrangement affixed at one end onto the blade support of said first conductive post and having at least one contact disposed at the other end thereof; a second conductive post extending into the interior of said enclosure means and having a contact disposed thereon adapted to close with the at least one contact disposed on the blade; and an actuator mechanism including an outer arm disposed on the exterior of said enclosure means and having one end positioned at said flex portion, an inner arm disposed on the interior of said enclosure means and coupled to said one end of the outer arm to move with said outer arm generally toward and away from said surface of the enclosure means, resilient means mounted between said enclosure means and one of said inner and outer arms to urge the outer arm away from said surface of the enclosure means, and a blade actuating member disposed between said inner arm and said blade arrangement to urge said blade arrangement to move in response to movement of said outer arm to selectively close said contacts.

14. A sealed switch assembly comprising a generally sealed casing defining an interior and an exterior and having a plurality of arcuate indentations on one surface thereof to define a flex area therebetween; a control lever having one end affixed to said flex area on the exterior of the casing; a helper spring disposed between the control level and the casing and generally urging said control lever away from the casing; linking means have one end affixed to said flex area on the interior of the casing so that said linking means moves toward and away from said one surface of the casing in concert with said control lever; and switching means inside said casing coupled to said linking lever to selectively open and close in response to movement of said control lever, and having electrodes extending therefrom through said casing.

15. A sealed switch according to claim 14, wherein the electrodes of said switch means includes a common electrode, a normally-open electrode, and a normally-closed electrode.

16. A sealed switch mechanism comprising a generally sealed casing defining an interior and an exterior and having at least one arcuate indentation on one surface thereof to define a flex area; a control lever having one end affixed to said flex area on the exterior of the casing; a helper spring affixed to the control lever and disposed therebetween and the casing and generally urging said control lever away from said casing when said control lever is fully depressed; switching means in the interior of said casing and having electrodes extending to the exterior of said casing; and linking means coupled to said switching means and having a portion affixed to said flex area on the interior of said casing for actuating said switching means in response to movement of said control lever toward and away from said casing.

17. A sealed switch mechanism comprising a generally sealed casing defining an interior and an exterior and having a pair of generally crescent-shaped indentations in one surface thereof, with one of said pair being convex and the other of said pair being concave, when viewed from the exterior of said casing; a control lever fixedly mounted between said indentations on the exterior of said casing and extending generally over said concave indentation; a helper leaf spring disposed between the control lever and the casing and generally urging said control lever away from said casing; switching means inside said casing and having electrodes extending to the exterior of said casing; and linking means coupled to said switching means and having a portion affixed between said indentations on the interior of said casing for actuating said switching means in response to movement of said control lever toward and away from said casing.

18. A sealed switch mechanism according to claim 17, wherein said crescent-shaped indentations are arranged to form a generally disc-shaped area therebetween.

19. A sealed switch mechanism comprising a generally sealed housing defining an interior and an exterior and including a base plate, a metal casing, and means sealing the casing and the base plate, the metal casing having a flex portion formed on a surface thereof adapted for flex movement with relation to the remainder of the surface; a metal control lever having one end welded to said flex portion on the exterior of the casing; a helper spring disposed between the control lever and the casing and generally urging said control lever away from said casing and maintaining said urging substantially continuously while said control lever is depressed toward said casing; switching means in the interior of said housing and having electrodes extending through the base plate; and linking means coupled to said switching means and having a portion welded to said flex portion on the interior of said casing for actuating said switching means in response to movement of said control lever toward and away from said casing.

20. A sealed switch mechanism comprising a generally sealed housing defining an interior and an exterior and including a base plate, a metal casing, and means sealing the casing and the base plate, the metal casing having a flex portion formed on a surface thereof adapted for flex movement with relation to the remainder of the surface; a metal control lever having one end welded to said flex portion on the exterior of the casing; a helper spring disposed between the control lever and the casing and generally urging said control lever away from said casing; switching means in the interior of said housing and having electrodes extending through the base plate; and linking means coupled to said switching means and having a portion welded to said flex portion on the interior of said casing for actuating said switching means in response to movement of said control lever toward and away from said casing, wherein said linking means includes means insulating said metal casing and said control lever from said switching means.

21. A sealed switch mechanism comprising a generally sealed housing defining an interior and an exterior and including a base plate, a metal casing, and means sealing the casing and the base plate, the metal casing having a flex portion formed on a surface thereof adapted for flex movement with relation to the remainder of the surface; a metal control lever having one end welded to said flex portion on the exterior of the casing; a helper spring disposed between the control lever and the casing and generally urging said control lever away from said casing, wherein said helper spring includes a leaf spring welded to said control lever near said one end thereof; switching means in the interior of said housing and having electrodes extending through the base plate; and linking means coupled to said switching means and having a portion welded to said flex portion on the interior of said casing for actuating said switching means in response to movement of said control lever toward and away from said casing.

22. A sealed switch mechanism comprising a generally sealed housing defining an interior and an exterior and including a base plate, a metal casing, and means sealing the casing and the base plate, the metal casing having a flex portion formed on one surface thereof adapted for flex movement with relation to the remainder of the one surface; a metal control lever having one end welded to said flex portion on the exterior of the casing; a helper leaf spring having one end welded to said control lever and another end in slidable contact against the casing; switching means in the interior of said housing and having electrodes extending to the exterior of said housing; and linking means coupled to said switching means and having a portion welded to said flex portion, for actuating said switching means in response to movement of said control lever toward and away from said casing.

* * * * *